United States Patent [19]

Bonmassari et al.

[11] Patent Number: 5,034,573

[45] Date of Patent: Jul. 23, 1991

[54] CONTACT-TYPE KEYBOARD

[75] Inventors: Gianpaolo Bonmassari, Ivrea; Claudio Gillio, Brosso Canavese, both of Italy

[73] Assignee: Ing. C. Olivetti & C., S.p.A., Turin, Italy

[21] Appl. No.: 535,486

[22] Filed: Jun. 11, 1990

[30] Foreign Application Priority Data

Jun. 29, 1989 [IT] Italy ..... 67532 A/89

[51] Int. Cl.[5] ..... H01H 13/70

[52] U.S. Cl. ..... 200/5 A; 200/517

[58] Field of Search ..... 200/5 A, 512–517, 200/341–345, 314, 306

[56] References Cited

U.S. PATENT DOCUMENTS

| | | | |
|---|---|---|---|
| 4,246,452 | 1/1981 | Chandler | 200/6 A X |
| 4,319,099 | 3/1982 | Asher | 200/5 A |
| 4,511,769 | 4/1985 | Sahakian et al. | 200/517 X |
| 4,527,030 | 7/1985 | Oelsch | 200/5 A X |
| 4,590,342 | 5/1986 | Schlegel | 200/341 |
| 4,678,880 | 7/1987 | Koizumi et al. | 200/513 |

FOREIGN PATENT DOCUMENTS

| | | | |
|---|---|---|---|
| 3421319 | 12/1985 | Fed. Rep. of Germany | 200/517 |

*Primary Examiner*—J. R. Scott

*Attorney, Agent, or Firm*—Banner, Birch, McKie & Beckett

[57] ABSTRACT

The contact-type keyboard comprises a plurality of keys which are movable from a rest position to an operative position and which each have a sleeve capable of being accommodated in a tube provided on the upper part of a dome portion of elastomeric material. Each dome portion projects from a mat and, below the tube, comprises an internal circular ring provided with a movable conductive portion for short-circuiting a corresponding fixed conductor of a printed circuit which in turn is carried by a stop plate of insulating material. Each sleeve is of such a length as to pass internally by way of an upper opening through the dome portion, to engage a through hole in the plate to project downwardly beyond the plate and comprises a seat capable of accommodating a corresponding pin of a support frame structure so as to guide the respective key from the rest position to the operative position and vice-versa. The support frame structure is positioned below the stop plate at a predetermined spacing such that it does not interfere with the end of the sleeve when the respective key is in the operative position. The key is in turn restrained to the plate by means of a lateral appendix which is freely accommodated by a seat in the plate and provided with a hook portion which is retained by the plate.

15 Claims, 2 Drawing Sheets

CONTACT-TYPE KEYBOARD

BACKGROUND OF THE INVENTION

The present invention relates to a contact-type keyboard comprising a support plate; a plurality of contacts which are fixed with respect to said support plate; a plurality of keys which are movable from a rest position to an operative position and each of which has an actuating element; a plurality of movable contacts and a corresponding plurality of dome elements, of elastomeric material, which are each interposed between the actuating element of a key and a movable contact; wherein each dome element is capable of elastic deformation in response to the movement of an actuator element to bring the movable contact into contact with the fixed contact and wherein the keys are restrained with respect to the support plate by means of hooking appendices engaged in associated fixed seats.

DESCRIPTION OF THE PRIOR ART

U.S. Pat. No. 3,829,646 discloses a keyboard of this type in which each key has a lower portion which operates as an actuating element to co-operate with the upper portion of a respective dome element to move the movable contact towards the fixed contact. The various dome elements are provided by a single mat which is restrained to the two support plates. The single restraints of the keys are formed by hooking arms which pivot on corresponding seats of the mat, which define the dome elements. That keyboard is simple and economic but it suffers from the disadvantage that the arms project from the keys, resulting in imprecise positioning of the keys, with consequential uncertainty in regard to electrical contact between the movable and fixed contacts.

SUMMARY OF THE INVENTION

It is, therefore, an object of the invention to provide a contact-type keyboard which is simple and inexpensive and which is reliable and very easy to use.

The contact-type keyboard of the invention comprises a support plate, and an insulating plate restrained with respect to said support plate and having a plurality of fixed seats formed therein. A plurality of fixed contacts are carried by said insulating plate and are fixed with respect to said support plate. The keyboard further includes a plurality of keys movable from a rest position to an operative position and each including an actuating element and a hooking extension engageable with one of said plurality of fixed seats and a plurality of movable contacts. A plurality of dome elements of elastomeric material are each interposed between the actuating element of a respective one of said plurality of keys and one of said plurality of movable contacts. Each of said plurality of dome elements is capable of elastic deformation in response to the movement of said actuator element to bring said corresponding movable contact into contact with one of said plurality of fixed contacts. Each of said dome elements has formed therein an upper opening.

A plurality of first guide members on said support plate project towards one of said plurality of dome elements and a corresponding plurality of second guide members is provided each of which is guided slidably by one of said plurality of first guide members, so that said plurality of keys are restrained with respect to said support plate by the engagement of said hooking extensions with said fixed seats; and movement of each of said keys between said rest position and said operative position is guided by the slidable engagement of said respective first and second guide members, said second guide member passing through the upper opening of the dome element associated with said key.

BRIEF DESCRIPTION OF THE DRAWINGS

A detailed description of the preferred embodiment of the invention is set forth in the following description (which is given by way of non-limiting example) with reference to the accompanying drawings in which.

DETAILED DESCRIPTION OF A PREFERRED EMBODIMENT

Figure 1:
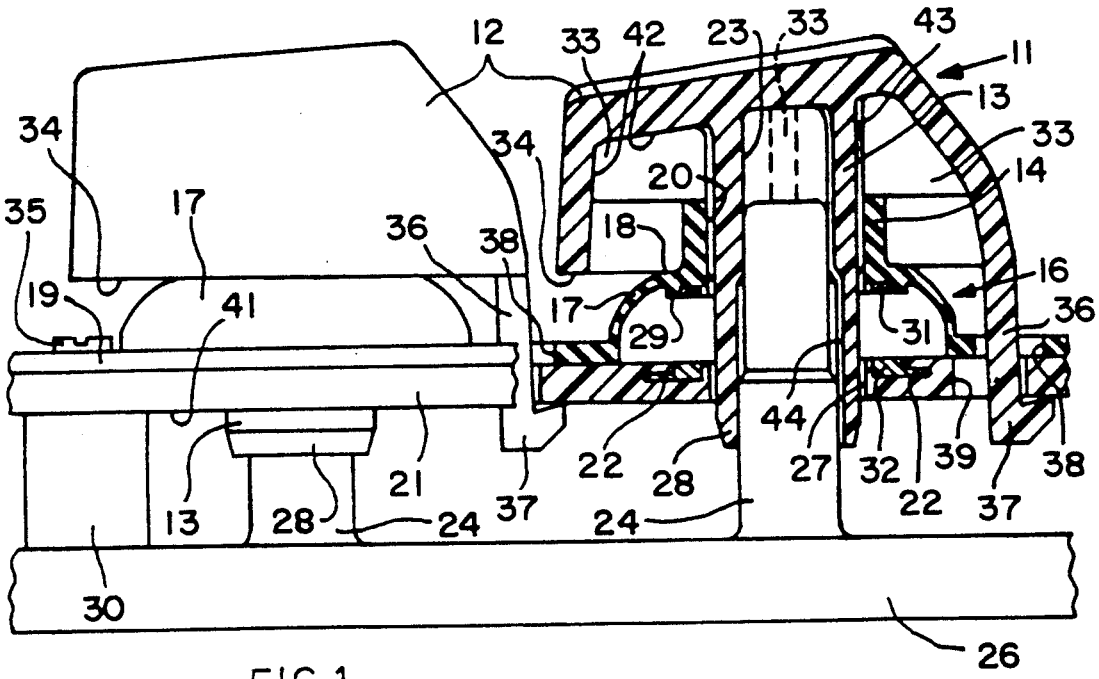
FIG. 1 is a side view of part of the keyboard according to the invention.
Figure 2:
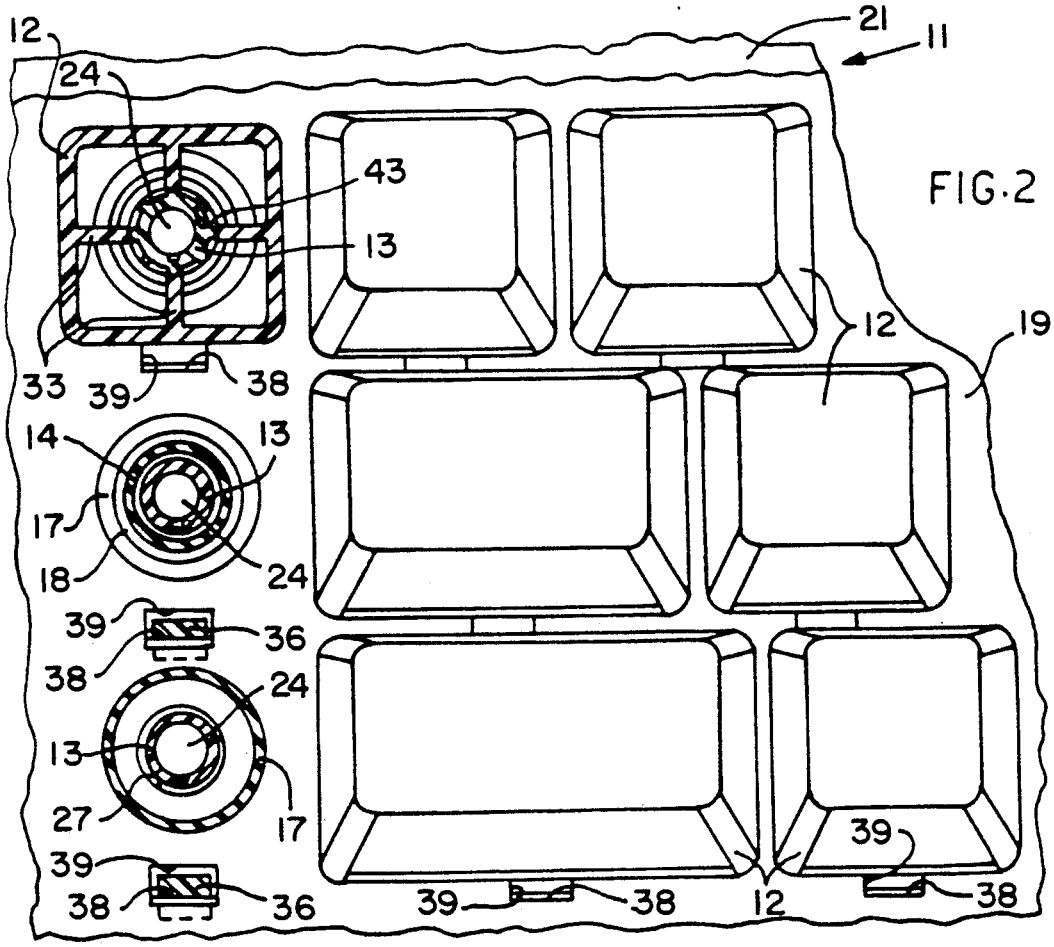
FIG. 2 is a plan view of part of the keyboard shown in FIG. 1, on a different scale.
Figure 3:
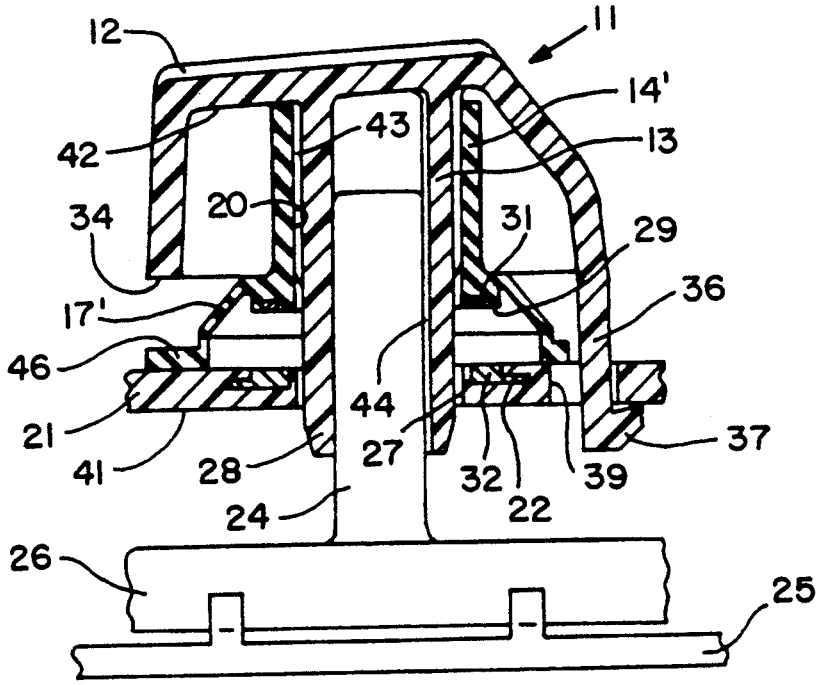
FIG. 3 is a side view of part of a first alternative embodiment of the keyboard shown in FIG. 1.
Figure 4:
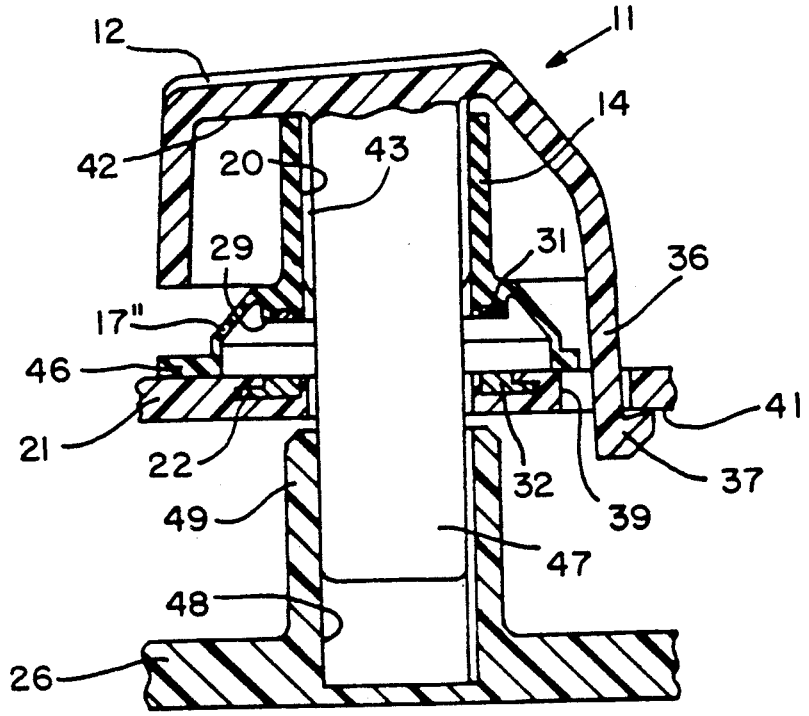
FIG. 4 is a side view of part of a second alternative embodiment of the keyboard shown in FIG. 1.

Referring to FIGS. 1 and 2, the contact-type keyboard according to the invention is generally identified by reference numeral 11 and comprises a plurality of keys 12 which are movable from a rest position to an operative position. Each key 12 comprises an actuator 13 formed by a sleeve of a predetermined length, co-operable with a cylindrical tube 14 of a resilient element 16. Each resilient element 16 comprises a dome portion 17 of elastomeric material which in the upper part has an external circular ring 18, adjacent to which the tube 14 projects upwardly therefrom. The dome portion 17 may be made individually as shown in FIGS. 3 or 4 or may be part of a single mat 19 as shown in FIGS. 1 and 2. The mat 19 is positioned on an insulating plate or stop plate 21 which carries a printed circuit 22 of electrically conductive material.

Each sleeve 13 is accommodated within the respective tube 14, is hollow in its interior and defines a seat 23 capable of accommodating a pin 24, which projects towards the dome portion 17, of a support plate or frame structure 26, for guiding the respective key 12 from the rest position to the operative position and viceversa. Each sleeve 13 is of a predetermined length such as to pass internally by way of an upper opening 20 through the dome portion 17, to engage a through hole 27 in the support plate 21 to project downwardly beyond the support plate 21. The support structure 26 is disposed beneath the stop plate 21 at a predetermined spacing which does not interfere with the end 28 of the sleeve 13 when the respective key 12 is in the operative position. The support structure 26 from which project the pins 24 which are capable of engaging the seats 23 of the respective sleeves 13 may be either an integral part of the body of the machine or it may constitute an intermediate support frame structure which in turn is supported by the body of the machine, indicated at 25 as shown in diagrammatic form in FIG. 3.

The support plate 21 (FIGS. 1 and 2) is in turn fixed to the support structure 26 by means of spacers 30 and screws 35, in per se known manner.

Each dome portion 17 comprises an internal circular ring 29 which is opposite to the external circular ring 18 and which has at least one movable contact element or conductive portion 31 formed by a conductive elastomer for short-circuiting a fixed contact or part 32 of the printed circuit 22 in the form of a circular ring when the corresponding key 12 is in the operative position. Each actuator or sleeve 13 comprises an engagement or actuator element 33 co-operable with the tube 14 of the respective dome portion 17 to position the conductive portion 31 against the corresponding portion 32 of the printed circuit 22.

Each key 12 comprises on three sides a lower edge 34 capable of arresting the travel movement of the respective key 12 towards the elastomeric mat 19 when the key 12 is in the operative position. A flexible blade 36 with a hook 37 at its end projects from the lower edge 34 of the fourth side.

In an operation for assembly of the key 12 with the dome portion 17, the blade 36 is elastically deformable to permit the hook 37 to pass through an opening 38 in the mat 19 and a seat 39 in the stop plate 21 and, subsequently to the elastic blade 36 being released, to come into engagement with the lower edge 41 of the stop plate 21 to hold the respective key 12 in the rest position. It will be clear that assembly of the keyboard is a very quick and easy operation due to the absence of further restraint means for the key 12. In addition, replacement of the key and checking of the contacts are also very simple operations.

Each key 12, when in its rest position, by means of its engagement element 33, does in fact hold the respective dome portion 17 pressed lightly against the stop plate 21 and preloads the dome portion 17. The dome portion 17 thus exerts an upward force which holds the respective key 12 in a raised position in alignment with the other keys 12 and holds the respective hook 37 in an arrested condition against the lower edge 41 of the stop plate 21.

Each engagement element 33 comprises four mutually perpendicular ribs which connect the sleeve 13 to the internal surfaces 42 of the respective key 12. Each sleeve 13 is provided on a part of its external surface which co-operates with the internal surface of the tube 14 of the respective dome portion 17 with a series of projections 43 of semicylindrical shape, which define passages for air during the movement of the key 12 to make the movement of the key easier and to provide constant damping for the key movement. Finally each seat 23 of the tube 13 has at least one radial groove 44 over its entire length to permit air to pass therethrough during the movement of the key 12, which is also operative to make the movement of the key easy and to dampen same.

The mode of operation of the contact-type keyboard 11 is as follows:

When the operator depresses a key 12, he causes the respective sleeve 13 to slide axially on the pin 24. The engagement element 33 which is always in contact with the tube 14 moves it downwardly, deforming the dome portion 17, and causes the conductive portion 31 to come into engagement with the portion 32 thereby to generate a corresponding electrical signal. Finally the lower edge 34 of the key 12 comes to bear against the mat 19 and stops the travel movement of the key. As soon as the operator releases the key 12, the resilient action of the dome portion 17 rapidly returns the respective key 12 to the rest position, holding it in its rest position with the hook 37 engaged and arrested against the lower edge 41 of the stop plate 21.

It will be clear that the keyboard according to the invention is not limited just to the above-described construction but may involve various modifications and addition of parts and other improvements without departing from the scope of the invention.

In particular, in the alternative embodiment shown in FIG. 3, the dome portion 17', besides being an individual component which is not connected to a mat 19, is of a different external shape from the dome portion 17 in FIGS. 1 and 2. The tube which is indicated herein at 14' is longer in an upward direction and is in contact with an internal surface 42 of the key 12 and thus in this case is actuated directly by the surface 42. In addition the circular surface by means of which the dome portion 17' is supported on the support plate 21, indicated herein at 46, is without a sector at a position corresponding to the seat 39 to permit the resilient blade 36 to pass freely therethrough.

More generally, the keys 12 may be guided by first guide members for the key 12, which are different from the sleeve, and second guide members which project from the support plate 26 and are different from the pins 24, being co-operable slidable with the first key guide means. In particular, in the alternative embodiment shown in FIG. 4, the key comprises, as the first guide member, a pin which is indicated at 47 and which is capable of being accommodated in a seat 48 of a second guide member formed by a sleeve 49 projecting from the support structure 26. In this case the key 12 is guided in its movement from the rest position to the operative position and vice-versa by the pin 47 which is accommodated in the sleeve 49 and not as described hereinbefore with reference to FIGS. 1 and 2. Finally, in the alternative embodiment shown in FIG. 4, the elastomeric dome portion which is indicated by reference numeral 17'' is substantially the same as the dome portion 17' in FIG. 3, but it could also be the same as the dome portion 17 in FIG. 1.

What we claim is:

1. A contact-type keyboard comprising:

a support plate;

an insulating plate restrained with respect to said support plate and having a plurality of fixed seats formed therein;

a plurality of fixed contacts carried by said insulating plate and fixed with respect to said support plate;

a plurality of keys movable from a rest position to an operative position and each including an actuating element and a hooking extension engageable with one of said plurality of fixed seats;

a plurality of movable contacts;

a plurality of dome elements of elastomeric material each of which is interposed between the actuating element of a respective one of said plurality of keys and one of said plurality of movable contacts; each of said plurality of dome elements being capable of elastic deformation in response to the movement of said actuator element to bring said corresponding movable contact into contact with one of said plurality of fixed contacts; each of said dome elements having formed therein an upper opening;

a plurality of first guide members on said support plate each of which said first guide members projects towards one of said plurality of dome elements; and a corresponding plurality of second guide members each of which is guided slidably by one of said plurality of first guide members;

whereby said plurality of keys are restrained with respect to said support plate by the engagement of said hooking extensions with said fixed seats; and movement of each of said keys between said rest position and said operative position is guided by the slidable engagement of said respective first and second guide members, said second guide member passing through the upper opening of the dome element associated with said key.

2. The invention set forth in claim 1 wherein each dome element comprises a cylindrical tube which defines said upper opening and is capable of accommodating a respective one of said first guide members.

3. The invention set forth in claim 2 wherein each dome element comprises an external circular ring adjacent to said tube and an internal circular ring opposite to said tube and to said external circular ring, and has at least one movable contact element for short-circuiting the corresponding fixed contact of a printed circuit when the corresponding key is in the operative position; said printed circuit being disposed on said insulating plate.

4. The invention set forth in claim 3 wherein each actuating element comprises an engagement surface adjacent to said second guide member and co-operable with the tube of each said dome element for positioning the movable contact element against the corresponding fixed contact of said printed circuit.

5. The invention set forth in claim 1 wherein said first guide member is of a length such as to pass freely into said upper opening through said dome element so as to engage one of said through holes in said insulating plate and to project downwardly beyond said insulating plate.

6. The invention set forth in claim 1 wherein each of said first guide members comprises a pin and each second guide member comprises a sleeve and wherein each pin is capable of being accommodated in a seat of the respective sleeve for guiding it during movement of the key between said rest position and said operative position.

7. The invention set forth in claim 6 wherein each actuator element comprises four mutually perpendicular ribs connecting the sleeve to internal surfaces of said key.

8. The invention set forth in claim 6 wherein each sleeve is provided on a part of its external surface which co-operates with the internal surface of the tube of the respective dome element with a series of projections of semicylindrical shape which define passages for air during the movement of said key thereby to make the movement of said key easy and substantially constantly damped.

9. The invention set forth in claim 6 wherein an internal seat of each sleeve has at least one radial groove over its entire length to permit air to pass therethrough during movement of said key and thus to make the movement of the key easier, uniform and substantially constantly damped.

10. The invention set forth in claim 6 wherein said support plate is positioned beneath said insulating plate at a distance such as not to interfere with said sleeve when said respective key is in the operative position.

11. The invention set forth in claim 6 wherein said support plate comprises a support frame structure which is an intermediate part of the body which supports and accommodates the keyboard.

12. The invention set forth in claim 1 wherein said dome element projects from an elastomeric mat positioned on said insulating plate, said dome element being resiliently preloaded; and wherein the hooking extension comprises a flexible blade which at its end has a hook portion capable of passing through an opening in the mat and a seat in the insulating plate in order then to engage with the lower edge of said insulating plate in a condition of elastic deformation of said blade to hold the respective key in the rest position due to the resilient action of the respective dome element.

13. The invention set forth in claim 12 wherein each key comprises on three sides a lower edge capable of stopping the travel of the respective key towards said mat when said key is in the operative position, and wherein said flexible blade projects from the lower edge of the fourth side of each key; and wherein each key, when in the rest position, by means of its actuator element holds the respective dome element pressed lightly against the insulating plate to preload said dome element which thus holds the respective key in a raised position aligned with the other keys with the hook engaged and restrained against the lower edge of the insulating plate.

14. The invention set forth in claim 12 wherein the opening in the mat and the seat in the insulating plate are in the same vertical plane and are adjacent to a respective through hole in the insulating plate.

15. The invention set forth in claim 6 wherein said support plate comprises a support frame structure which is an integral part of the body which supports and accommodates the keyboard.

* * * * *